US005772406A

United States Patent [19]

Takai

[11] Patent Number: 5,772,406

[45] Date of Patent: Jun. 30, 1998

[54] PISTON-TYPE COMPRESSOR WITH A LUBRICATING SYSTEM

[75] Inventor: Kazuhiko Takai, Gunma, Japan

[73] Assignee: Sanden Corporation, Gunma, Japan

[21] Appl. No.: 404,376

[22] Filed: Mar. 15, 1995

[30] Foreign Application Priority Data

Mar. 18, 1994 [JP] Japan ..... 6-048406

[51] Int. Cl.[6] ..... F04B 1/12

[52] U.S. Cl. ..... 417/269; 92/153; 184/18

[58] Field of Search ..... 417/269; 92/153, 92/160, 159; 184/18

[56] References Cited

U.S. PATENT DOCUMENTS

| | | |
|---|---|---|
| 1,369,592 | 2/1921 | White . |
| 1,565,299 | 12/1925 | Wenzel . |
| 1,581,312 | 4/1926 | Fryoux, Jr. et al. . |
| 1,815,354 | 7/1931 | Grant . |
| 2,372,979 | 4/1945 | Phillips . |
| 3,359,872 | 12/1967 | Foster . |
| 3,727,927 | 4/1973 | Packard . |
| 4,413,954 | 11/1983 | Okazaki ..... 417/269 |
| 4,594,055 | 6/1986 | Hatakeyama et al. ..... 417/269 |
| 4,681,326 | 7/1987 | Kubo . |
| 4,697,992 | 10/1987 | Hatakeyama et al. ..... 417/269 |
| 4,835,856 | 6/1989 | Azami . |

FOREIGN PATENT DOCUMENTS

| | | |
|---|---|---|
| 1193072 | 10/1959 | France . |
| 580393 | 11/1977 | U.S.S.R. . |

*Primary Examiner*—Timothy Thorpe
*Assistant Examiner*—Cheryl J. Tyler
*Attorney, Agent, or Firm*—Baker & Botts, L.L.P.

[57] ABSTRACT

A piston-type compressor is provided with a lubricating system for allowing passage of blowby gas from a piston chamber to a crank chamber, which is disposed opposite the piston from the piston chamber. A driving mechanism is disposed in the crank chamber and is coupled to the pistons to move the pistons in a reciprocating motion. The lubricating system may comprise at least one groove formed in an inner surface of at least one of the cylinders to allow passage of a fluid and a lubricating oil, via blowby gas, from the piston chamber to the crank chamber. The fluid may lubricate the moving parts of the driving mechanism.

21 Claims, 9 Drawing Sheets

PISTON-TYPE COMPRESSOR WITH A LUBRICATING SYSTEM

BACKGROUND OF THE INVENTION

1. Field of the Invention

The invention generally relates to a piston-type compressor. More particularly, the invention relates to a blowby gas lubricating system which can be used in, for example, a swash plate piston-type compressor of an automotive air conditioning system.

2. Description of the Related Art

In a compressor, such as a swash plate piston-type refrigerant compressor, lubrication for the driving mechanism in the crank chamber is generally supplied by blowby gas, which is mixed with lubricating oil in a mist state. The blowby gas is typically leaked from the piston chamber (ie. compression side of the piston) to the crank chamber through a gap between the peripheral surface of the piston and an inner surface of the respective cylinder bore.

Recently, however, cylinder blocks in such compressors have been formed of aluminum alloys in order to reduce the weight of the compressor. Seamless piston rings made of polytetrafluoroethylene ("PTFE") resin have been disposed about an outer peripheral surface of the piston to prevent wear of both the piston and its respective cylinder bore, which is typically caused by friction between these surfaces. Thus, the amount of blowby gas which is passed to the crank chamber is significantly reduced by this improved sealing structure. One method of overcoming this problem is shown in U.S. Pat. Nos. 4,835,856 and 5,169,162, both of which are issued to Azami et al. Referring to FIG. 1, a prior art compressor has piston rings 73 which are made of PTFE resin. Each ring 73 has a plurality of axial cut-out portions 73*a* to provide communication between the interior of the crank chamber and piston chamber 75, which is located on the opposite side of piston 71. Axial cut-out portions 73*a* are designed to allow sufficient passage of blowby gas to the crank chamber.

However, the depth of axial cut-out portions 73*a* of piston ring 73 is gradually reduced due to swelling of piston ring 73 after repeated operation of the compressor. Thus, the shape of cut-out portions 73*a* changes over time and the amount of blowby cannot be maintained at a constant level.

Further, in a compressor having a variable capacity mechanism, such as that shown in U.S. Pat. No. 5,174,727 issued to Terauchi et al, the compressor volume may be changed by changing an inclined angle of a cam rotor disposed in the crank chamber. Referring to FIG. 3, it is necessary to control the pressure in crank chamber 22 to change the compressor volume. Crank chamber 22 communicates with suction chamber 241 through a series of conduits, holes and valves, including passageway 18. Communication between these chambers is controlled by the opening and closing of a valve device. Accordingly, blowby gas is sometimes permitted to travel through passageway 18 to crank chamber 22 in order to control the pressure in crank chamber 22.

As mentioned above, blowby gas is very important for operating and maintaining the endurance of the compressor. However, forming the communication path for the blowby gas, including passageway 18, is typically complicated and costly. This is because, among other things, a capillary tube 183 must be inserted into passageway 18 to reduce the pressure of high-pressure refrigerant. Also, passageway 18 must be provided with a filter 182 for clearing any alien substances, which may be mixed in with the refrigerant. Other problems exist with conventional lubrication systems for piston-type compressors.

SUMMARY OF THE INVENTION

Therefore, it is an object of the present invention to provide a simplified lubricating system for use in a piston-type compressor. The system maintains a relatively constant passage of blowby gas to a crank chamber of the compressor.

According to one embodiment of the present invention, a compressor includes a compressor housing having a cylinder block, a front end plate disposed on one end of the cylinder block and a rear end plate disposed on an opposite end of the cylinder block. The rear end plate has a discharge chamber and a suction chamber formed therein. The cylinder block has a plurality of cylinders formed therein. The cylinder block defines a crank chamber between the front end plate and the cylinders. A valve plate is disposed between the cylinder block and the rear end plate and includes a plurality of discharge ports for passage of a compressed fluid from the plurality of cylinders. The valve plate also has a plurality of suction ports for passage of a fluid from the suction chamber into the cylinders. Discharge valve members are disposed adjacent the valve plate for opening and closing each of the discharge ports. Suction valve members are disposed adjacent the valve plate for opening and closing each of the suction ports. A driving mechanism is disposed at least partially within the crank chamber and is coupled to a plurality of pistons, one of which is slidably fitted within each of the plurality cylinders. A piston chamber is defined by each of the cylinders between the respective piston and the valve plate. At least one passage means is formed in an inner surface of at least one of the cylinders for allowing passage of a fluid from the suction chamber to the crank chamber. The passage means may comprise at least one groove, which may have several different axial and radial cross-sectional shapes, and different axial positions and lengths.

Further objects, features, and advantages of the present invention will be understood from the detailed description of the preferred embodiments with reference to the appropriate figures.

DETAILED DESCRIPTION OF THE PREFERRED EMBODIMENTS

Figure 4:
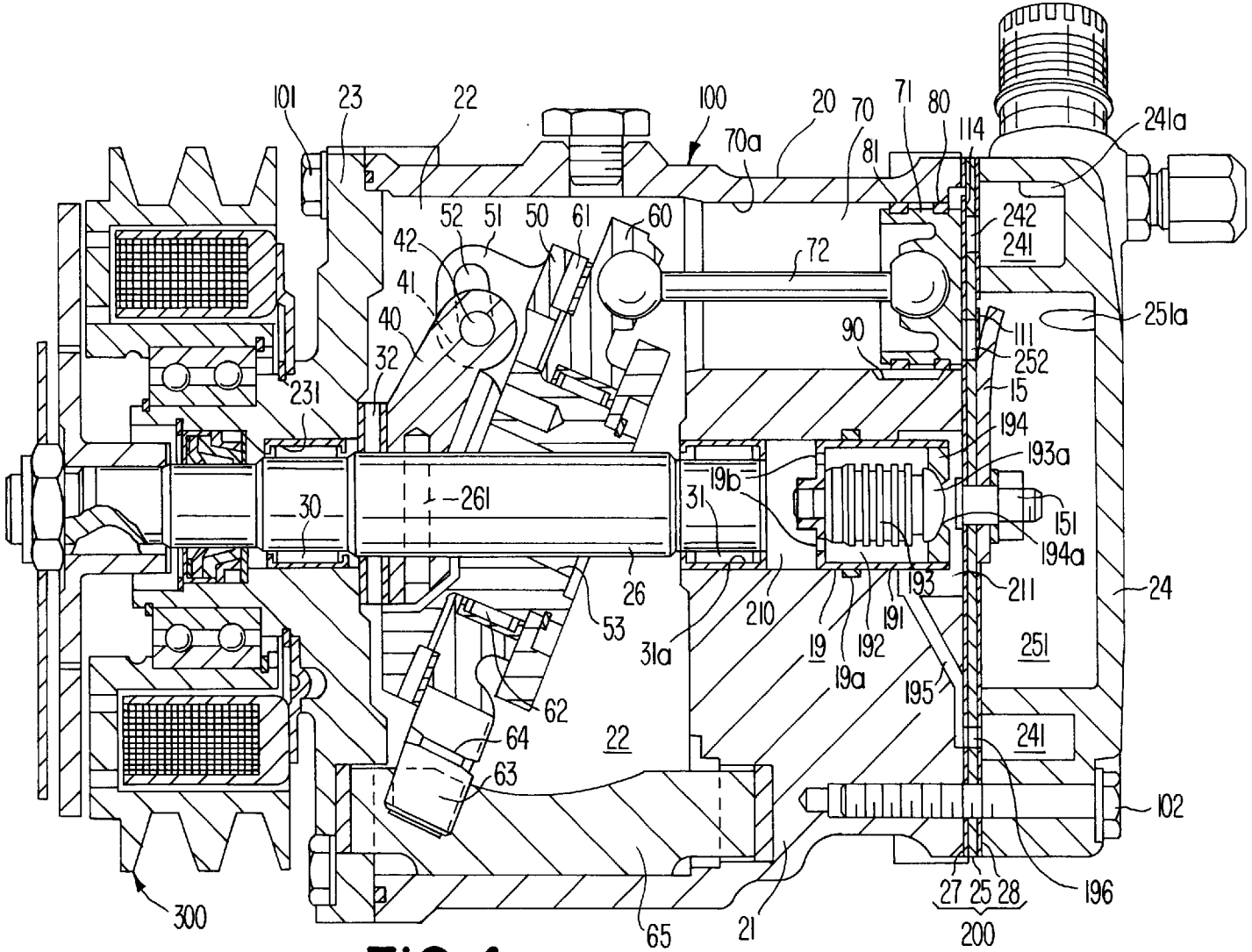
FIG. 4 is a longitudinal sectional view of a swash plate piston-type compressor in accordance with the present invention.

A description of an example piston-type compressor is provided, followed by details of several embodiments. Referring to FIG. 4, a variable capacity swash plate piston-type refrigerant compressor is shown. Compressor 100 includes a cylindrical housing assembly 20, which comprises a cylinder block 21, a front end plate 23 attached to one end of cylinder block 21, and a rear end plate 24 attached to the other end of cylinder block 21. Front end plate 23 is secured to one end of cylinder block 21 by a plurality of bolts 101. Rear end plate 24 is secured the other end of cylinder block 21 by a plurality of bolts 102. A valve plate 25 is disposed between rear end plate 24 and cylinder block 21. An opening 231 is centrally formed in front end plate 23 for supporting a drive shaft 26 through a bearing 30, which is disposed therein. An inner end portion of drive shaft 26 is rotatably supported by a bearing 31, which is disposed within a centrally formed bore 210 of cylinder block 21. Bore 210 extends to a rearward (to the right in FIG. 4) end surface of cylinder block 21 and houses valve control mechanism 19, which is further described below.

A cam rotor 40 is affixed to drive shaft 26 by a pin member 261 and rotates therewith. A trust needle bearing 32 is disposed between an inner end surface of front end plate 23 and an adjacent axial end surface of cam rotor 40. Cam rotor 40 includes an arm 41 having a pin member 42 extending therefrom. A slant plate 50 is disposed adjacent to cam rotor 40 and includes an opening 53 through which drive shaft 26 passes. Slant plate 50 includes an arm 51 having a slot 52. Pin member 42 slides within slot 52 to allow adjustment of the angular position of slant plate 50 with respect to the longitudinal axis of drive shaft 26. Slant plate 50 is rotatably coupled to a swash plate 60 through bearings 61 and 62. A fork-shaped slider 63 is attached to the outer peripheral end of swash plate 60 by a pin member 64 and is slidably mounted on a sliding rail 65, which is disposed between front end plate 23 and cylinder block 21. Fork-shaped slider 63 prevents rotation of swash plate 60. During operation, swash plate 60 nutates along sliding rail 65 as cam rotor 40 rotates with drive shaft 26. Cylinder block 21 includes a plurality of peripherally located cylinders 70 in which pistons 71 reciprocate. Each piston 71 is coupled to swash plate 60 by a corresponding connecting rod 72. Each piston 71 has a rear end on the side of said rear end plate and a front end on the side of said front end plate.

A pair of seamless piston rings 80 and 81 are preferably made of PTFE and are disposed about an outer peripheral surface of piston 71. First piston ring 80 and second piston ring 81 prevent wear of both aluminum alloy piston 71 and aluminum alloy cylinder block 21, which may otherwise be caused by friction therebetween. Piston rings 80 and 81 also prevent any direct contact between piston 71 and inner surface 70*a* of cylinder 70.

Rear end plate 24 includes a peripherally-positioned annular suction chamber 241 and a centrally-positioned discharge chamber 251. Valve plate 25 includes a plurality of valved suction ports 242 linking suction chamber 241 with respective cylinders 70. Valve plate 25 also includes a plurality of discharge ports 252 linking discharge chamber 251 with respective cylinders 70. Suction ports 242 and discharge ports 252 are provided with suitable reed valves. Suction valves 114 are provided on the cylinder block side of valve plate 25 for opening and closing the respective suction ports 242. Discharge valves 111 are provided on the discharge chamber side of valve 25 for opening and closing the respective discharge ports 252. The opening motion of each discharge valve 111 is restricted by a corresponding valve retainer 15.

Suction chamber 241 has an inlet port 241*a,* which is connected to an evaporator of an external cooling circuit (not shown). Discharge chamber 251 is provided with an outlet port 251*a,* which is connected to a condenser of cooling circuit (not shown). Gaskets 27 and 28 are positioned between cylinder block 21 and a front surface of valve plate 25, and between rear end plate 24 and a rear surface of valve plate 25, respectively. Gaskets 27 and 28 seal the mating surfaces of cylinder block 21, valve plate 25 and rear end plate 24. Gaskets 27 and 28, together with valve plate 25, comprise valve plate assembly 200.

A first communication path between crank chamber 22 and suction chamber 241 is formed in cylinder block 21. This first communication path includes bore 210. A valve control mechanism 19 is disposed within bore 210 and includes a cup-shaped casing member 191, which defines a valve chamber 192 therein. O-ring 19*a* is disposed between an outer surface of casing member 191 and an inner surface of bore 210 to seal the mating surface of casing member 191 and cylinder block 21. A plurality of holes 19*b* is formed at the closed end (to the left in FIG. 4) of cup-shaped casing member 191. A gap 31*a* exists between bearing 31 and cylinder block 21. Holes 19*b* and gap 31*a* permit communication between crank chamber 22 and valve chamber 192. Circular plate 194, having hole 194*a* formed at the center thereof, is fixed to the open end (to the right in FIG. 4) of cup-shaped casing member 191. Bellows 193 is disposed within valve chamber 192 and contracts and expands longitudinally in response to pressure changes within crank chamber 22. The forward end of bellows 193 (to the left in FIG. 4) is fixed to the closed end of casing member 191. Valve member 193*a* is attached at the rearward end of bellows 193 (to the right in FIG. 4) to selectively control the opening and closing of hole 194*a*. Valve chamber 192 and suction chamber 241 are linked by hole 194*a,* end portion 211 of bore 210, conduit 195 formed in cylinder block 21, and hole 196 formed in valve plate assembly 200. Valve retainer 15 is secured to the rear end surface of valve plate assembly 200 by bolt 151.

During operation of compressor 100, drive shaft 26 is rotated by an engine (e.g. a vehicle engine) (not shown) through electromagnetic clutch 300. Cam rotor 40 is rotated with drive shaft 26 causing slant plate 50 to rotate. The rotation of slant plate 50 causes swash plate 60 to nutate. The nutation of swash plate 60 reciprocates pistons 71 in their respective cylinders 70. As a piston 71 moves in a forward direction during a suction stroke, refrigerant gas which is introduced into suction chamber 241 through inlet portion 241*a* is drawn into a respective cylinder 70 through suction port 242. During a following compression stroke of piston 71, suction valve 114 closes suction port 242 and the refrigerant gas is compressed. The compressed gas is then discharged from cylinder 70 into discharge chamber 251 through discharge port 252 and then into the cooling circuit (not shown) through outlet port 251*a*.

When the gas pressure in crank chamber 22 exceeds a predetermined value, valve control mechanism 19 responds and hole 194*a* is opened by the contraction of bellows 193. The opening of hole 194*a* permits communication between crank chamber 22 and suction chamber 241. As a result, the slant angle of slant plate 50 is increased, thereby increasing the in displacement the compressor. On the other hand, when the gas pressure in crank chamber 22 is less than a predetermined value, hole 194*a* is closed by valve member 193*a* attached to bellows 193. This action blocks communication between crank chamber 22 and suction chamber 241 and results in a reduced compressor displacement.

Figure 5:
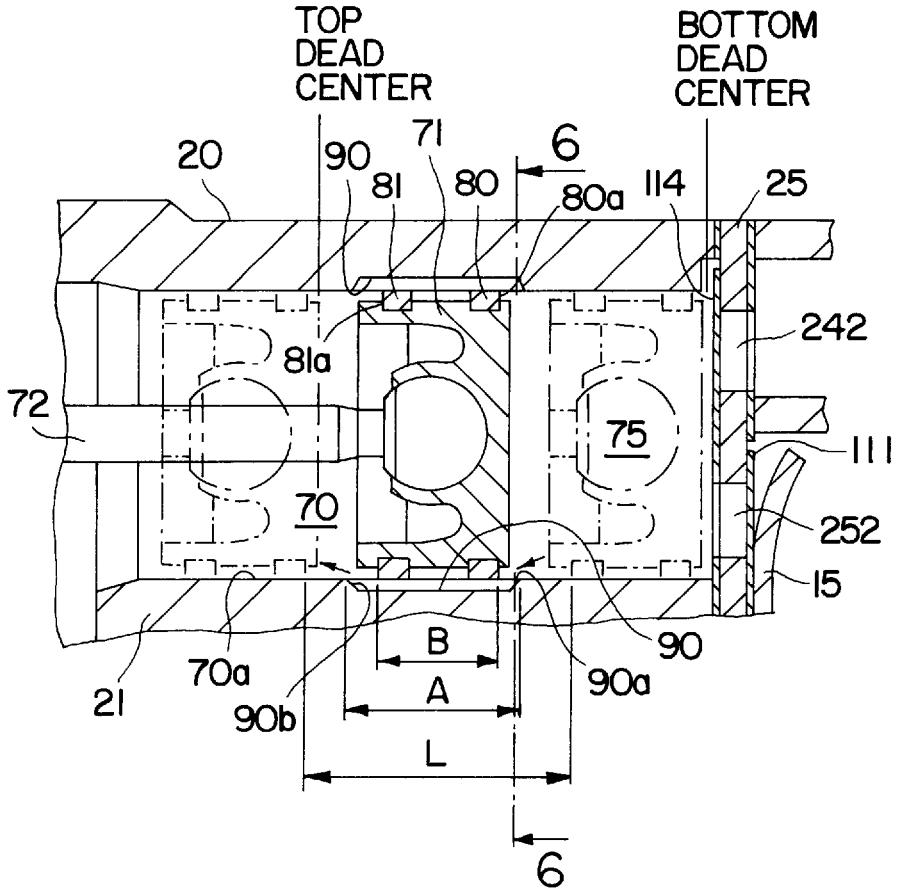
FIG. 5 is an enlarged sectional view of a cylinder in accordance with a first embodiment of the present invention.
Figure 6:
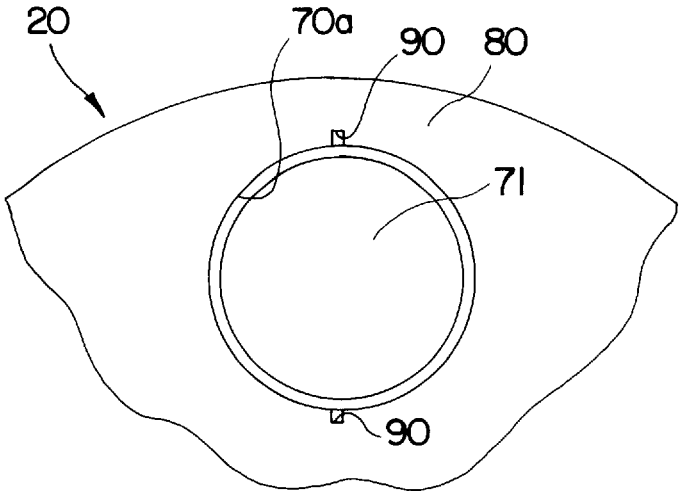
FIG. 6 is an enlarged fragmentary sectional side view taken along line 6—6 in FIG. 5.

FIGS. 5 and 6 illustrates a first embodiment of the present invention. In this embodiment, each of pistons 71 is provided with a first piston ring 80 disposed about a rearward outer peripheral surface of piston 71 and a second piston ring 81 disposed about a forward outer peripheral surface of piston 71. Inner surface 70*a* of cylinder 70 is provided with a plurality of grooves 90 thereon. Preferably, each groove 90 is axially formed and has a radial cross-section which is generally rectangular in shape, and has an axial cross-section which is generally a slender trapezoid. Preferably, end portions 90*a* and 90*b* are each formed to be inclined in the axial cross-section. The axial length of the incline should be greater than the radial depth of the incline. The shape of groove 90, including end portions 90*a* and 90*b*, thus permits smooth passage of fluid and lubricating oil from piston chamber 75 to crank chamber 22. At least one part of groove 90 is located in a surface portion L which is defined by cylinder 70 between axial right end 80*a* of first piston ring 80 when piston 71 is at top dead center and the axial left end 81*a* of second piston ring 81 when piston 71 is at bottom dead center. Preferably, axial length A of groove 90 is larger than distance B between axial right end 80*a* of first piston ring 80 and axial left end 81*a* of second piston ring 81. In this arrangement, the entire groove 90 is preferably located forward of left end 81*a* of second piston ring 81 when piston 71 is at bottom dead center.

Figure 1:
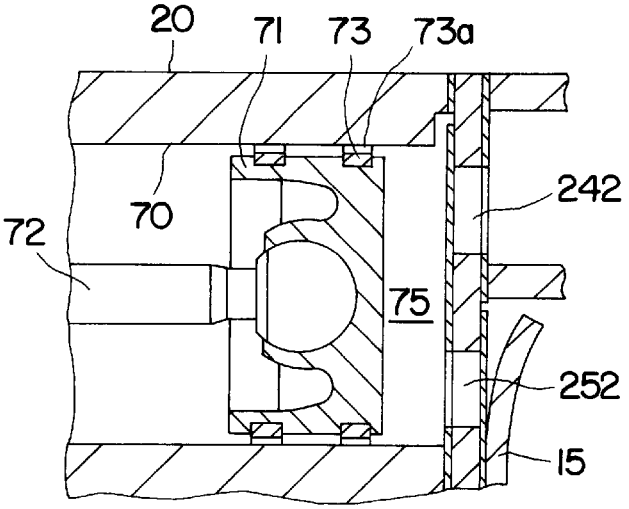
FIG. 1 PRIOR ART
FIG. 1 is an enlarged sectional view of a cylinder in accordance with the prior art.
Figure 2:
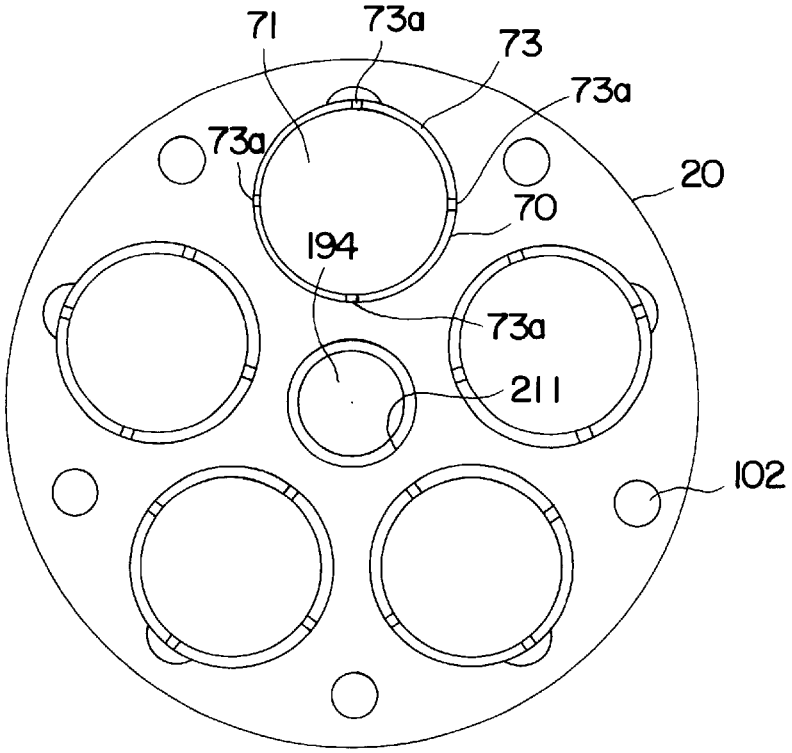
FIG. 2 PRIOR ART
FIG. 2 is a cross-sectional view of a piston-type compressor in accordance with the prior art.
Figure 3:
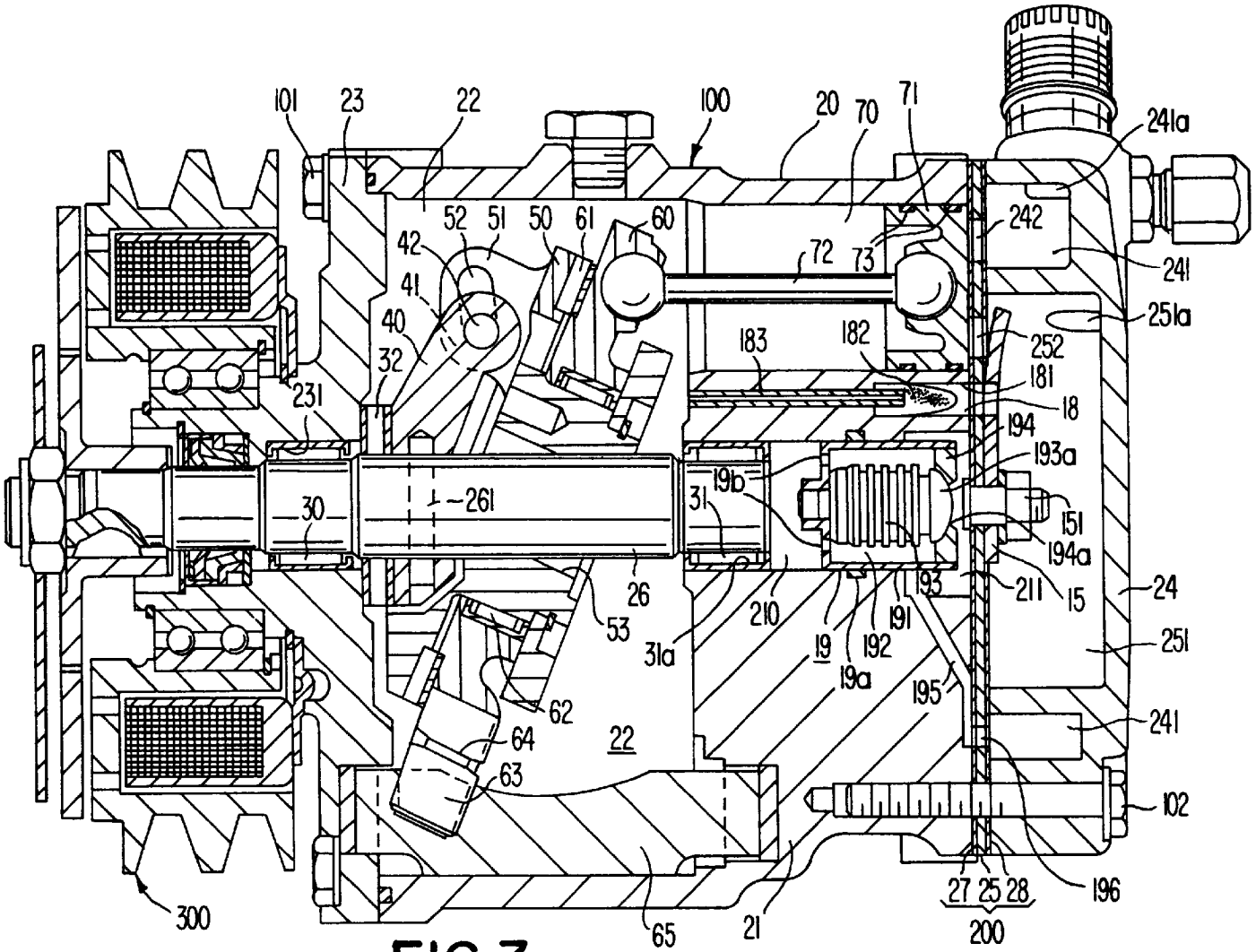
FIG. 3 PRIOR ART
FIG. 3 is a longitudinal sectional view of a swash plate piston-type compressor in accordance with the prior art.

During operation of the compressor, blowby gas passes by piston 71 from piston chamber 75 of piston 71 to crank chamber 22. This is shown as arrows in FIG. 5. This movement of blowby gas occurs as a passageway, which links the opposite sides of piston 71 is formed during the relatively short time that piston 71 is located axially adjacent groove 90 in the reciprocation process. Both the width and depth of groove 90 can be varied to regulate the amount of blowby gas. Groove 90 has advantages over conventional passageways for blowby gas. For example, groove 90 can be easily formed on inner surface 70*a* of cylinder 70 by a relatively simple cutting process. Also, groove 90 is not as susceptible to blockage by alien substances which may be mixed in with the refrigerant. This is because, among other reasons, groove 90 is partially opened (i.e., open to cylinder 70). Thus groove 90 is not confined such as, for example, passageway 18 in the prior art structure shown in FIG. 3. Further, the radial cross-sectional area of groove 90 is not as likely to be changed by possible expansion of piston rings 80 and 81. This simple structure ensures a relatively constant flow of blowby gas to crank chamber 22. Therefore, lubricating oil is constantly provided to crank chamber 22. As a result, the durability of the moving parts in crank chamber 22 is increased. Heat exchange efficiency of the cooling circuit (not shown) is also improved because the volume of lubricating oil flowing in the cooling circuit can be decreased.

Figure 7:
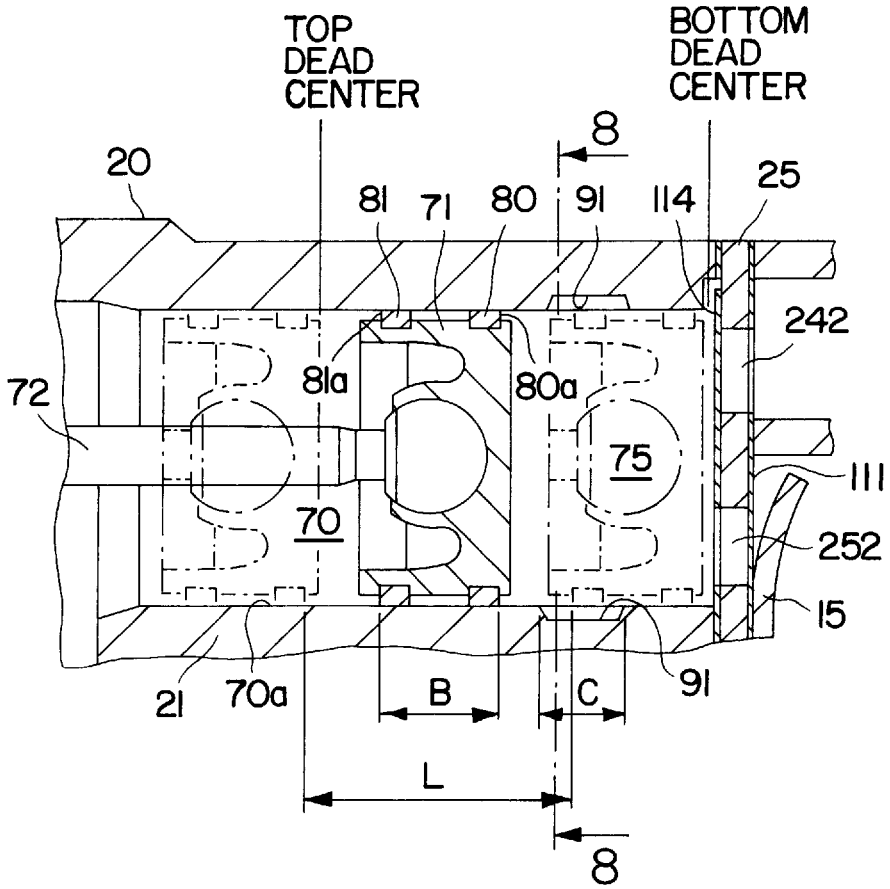
FIG. 7 is an enlarged sectional view of a cylinder in accordance with a second embodiment of the present invention.
Figure 8:
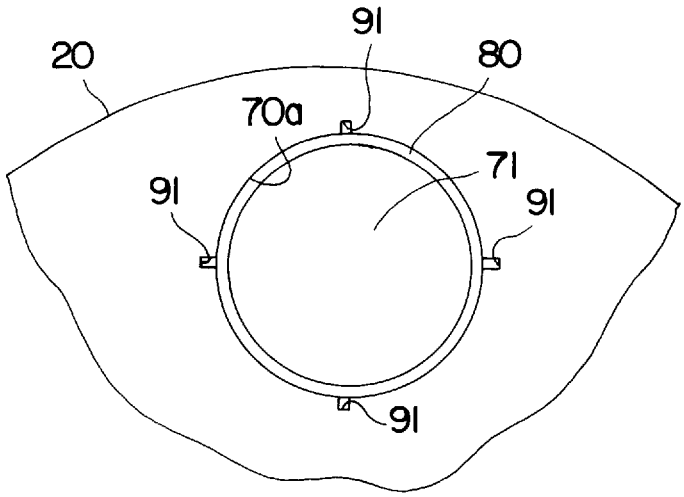
FIG. 8 is an enlarged fragmentary sectional side view taken along line 8—8 in FIG. 7.

FIGS. 7 and 8 illustrate a second embodiment of the present invention. A plurality of grooves 91 are axially formed on inner surface 70*a* of cylinder 70. Axial length C of each groove 91 may be smaller than distance B between axial right end 80*a* of first piston ring 80 and axial left end 81*a* of second piston ring 81 if at least one part of groove 91 is located within surface portion L. In this arrangement, left end 81*a* of second piston ring 81 is preferably radially adjacent groove 91 when piston 71 is at bottom dead center. Thus, during operation of the compressor, the refrigerant and lubricating oil remains in groove 91 during the suction stroke, and flows into crank chamber 22 only after left end 81*a* of second piston ring 81 passes the forward end 90*b* of groove 91 during the compression stroke.

Figure 9:
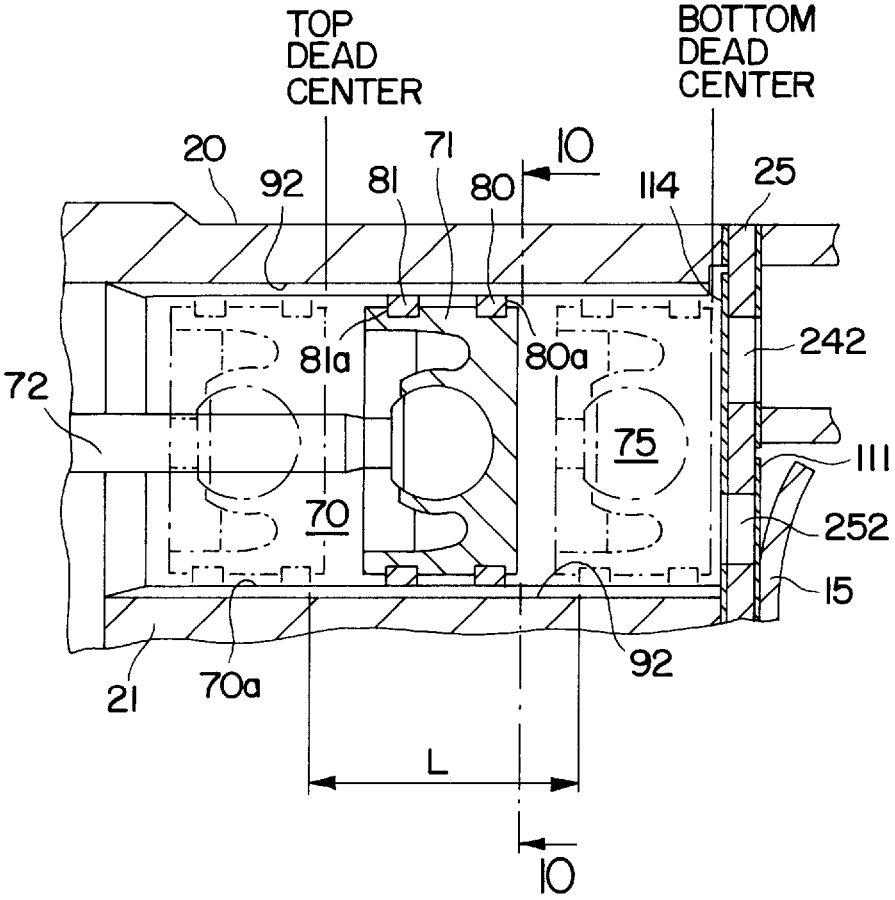
FIG. 9 is an enlarged sectional view of a cylinder in accordance with a third embodiment of the present invention.
Figure 10:
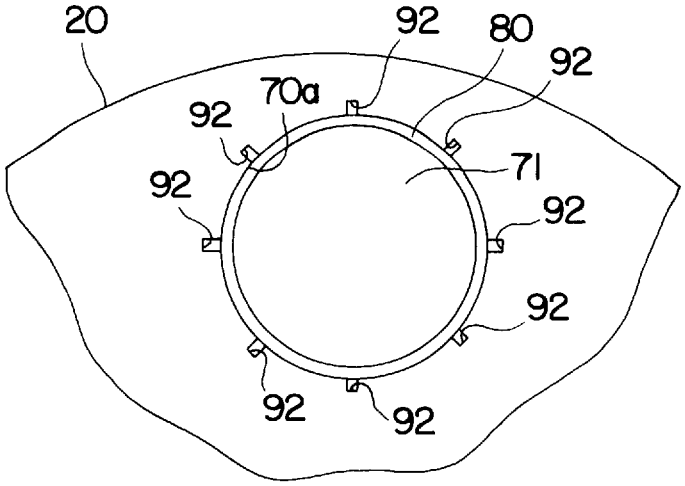
FIG. 10 is an enlarged fragmentary sectional side view taken along line 10—10 in FIG. 9.

FIGS. 9 and 10 illustrate a third embodiment of the present invention. A plurality of grooves 92 extend the entire distance from valve plate 25 to crank chamber 22. In this arrangement, blowby gas can travel to crank chamber 22 during the entire reciprocation cycle of piston 71.

Figure 11:
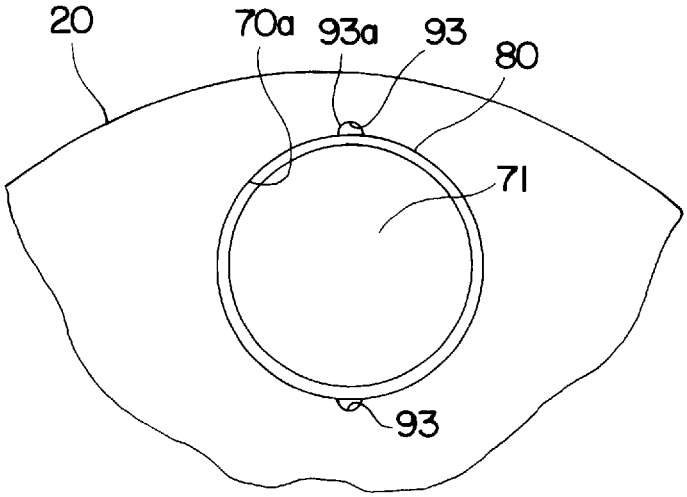
FIG. 11 is an enlarged fragmentary sectional side view of a cylinder in accordance with a fourth embodiment of the present invention.

FIG. 11 illustrates a fourth embodiment of the present invention. Inner surface 70*a* of cylinder 70 is provided with a plurality of grooves 93 thereon. Grooves 93 are preferably spaced apart at radially equivalent intervals and are preferably substantially parallel to the axis of cylinder 70. Although only two grooves are shown, one or more grooves may be provided. The plurality of grooves 93 may have a radial cross section which is substantially semicircular in shape and an axial cross section which is substantially rectangular or trapezoidal in shape. This embodiment may be combined with the various features of the first through third embodiments such as, for example, the axial position and length of the groove.

Figure 12:
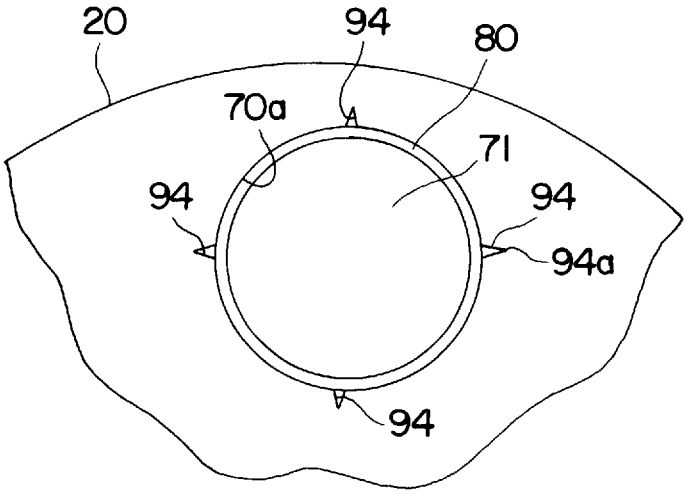
FIG. 12 is an enlarged fragmentary sectional side view of a cylinder in accordance with a fifth embodiment of the present invention.

FIG. 12 illustrates a fifth embodiment of the present invention. Inner surface 70*a* of cylinder 70 is provided with a plurality of grooves 94, thereon. Grooves 94 are preferably spaced apart at radially equivalent intervals and are preferably substantially parallel to the axis of cylinder 70. Although four grooves are shown in FIG. 12, one or more may be provided. The plurality of grooves 94 are formed with a substantially triangular radial cross section and a substantially rectangular or trapezoidal axial cross section. As with the fourth embodiment, this embodiment may be combined with various features of the first through third embodiments.

Figure 13:
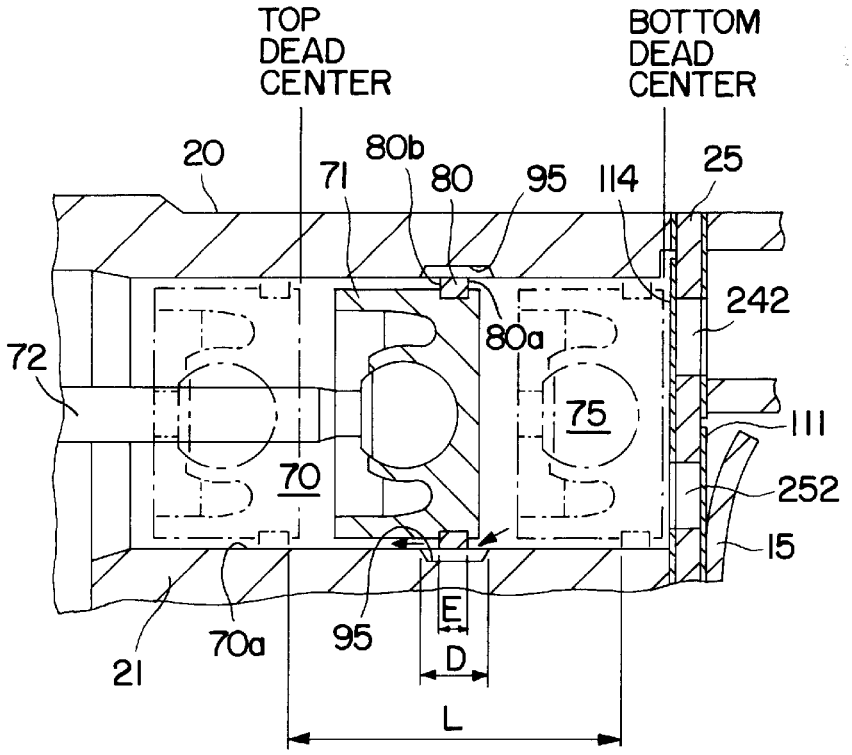
FIG. 13 is an enlarged sectional view of a cylinder in accordance with a sixth embodiment of the present invention.

FIG. 13 illustrates a sixth embodiment of the present invention. In this embodiment, piston 71 has only one piston ring, for example, first piston ring 80. A plurality of grooves 95 are formed in inner surface 70*a* of cylinder 70. At least a portion of each groove 95 is located in surface portion L which is defined by the axial right end 80*a* of first piston ring 80 when piston 71 is at top dead center, and the axial left end 80*b* of first piston ring 80 when piston 71 is at bottom dead center. Preferably, axial length D of groove 95 is larger than the axial thickness E of first piston ring 80. The axial and radial cross-sectional shapes of grooves 95 can be as already described.

Figure 14:
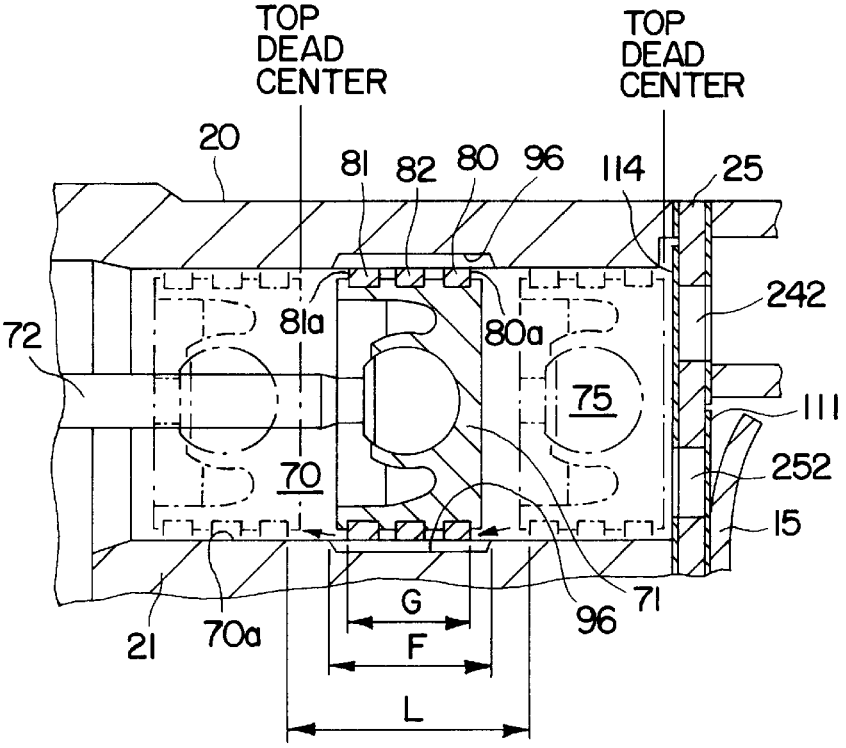
FIG. 14 is an enlarged sectional view of a cylinder in accordance with a seventh embodiment of the present invention.

FIG. 14 illustrates a seventh embodiment of the present invention. This embodiment is similar to the first embodiment, except that an additional third piston ring 82 is provided, preferably positioned between first and second piston rings 80 and 81. A plurality of grooves 96 are provided in inner surface 70*a* of cylinder 70. At least a portion of each groove 96 is located in surface portion L which is defined by axial right end 80*a* of first piston ring 80 when piston 71 is at top dead center, and axial left end 81*a* of second piston ring 81 when piston 71 is at bottom dead center. Preferably, axial length F of groove 96 is larger than distance G between axial right end 80*a* of first piston ring 80 and axial left end 81*a* of second piston ring 81. The axial and radial cross-sectional shapes of grooves 96 can be as already described.

Figure 15:
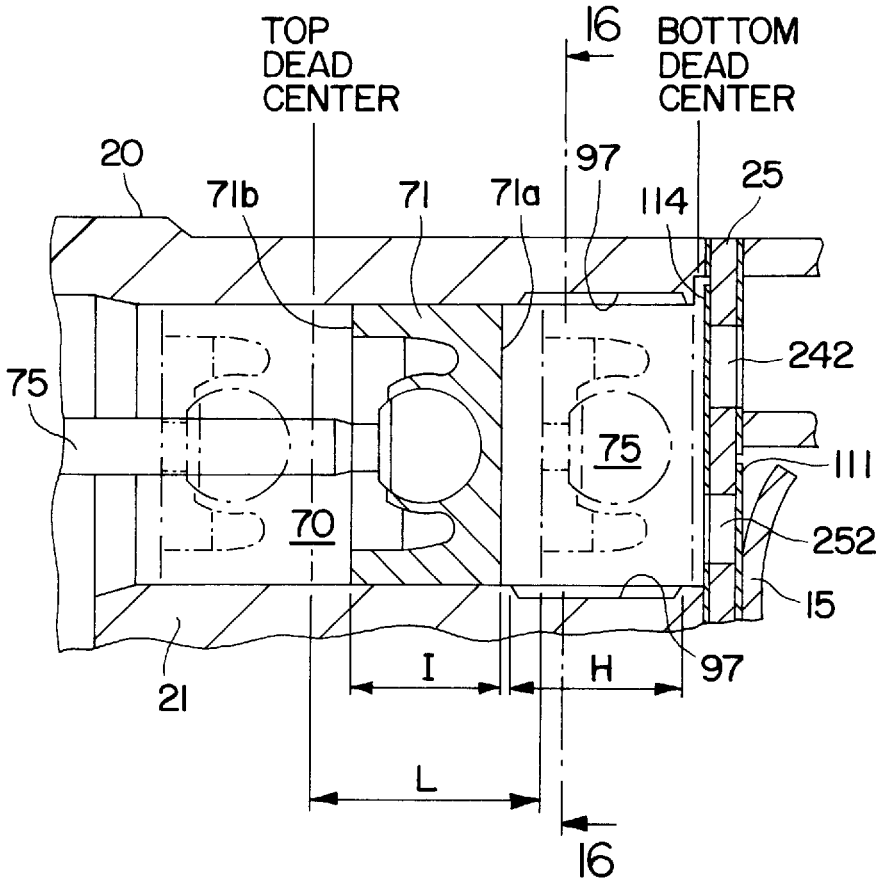
FIG. 15 is an enlarged sectional view of a cylinder in accordance with an eighth embodiment of the present invention.
Figure 16:
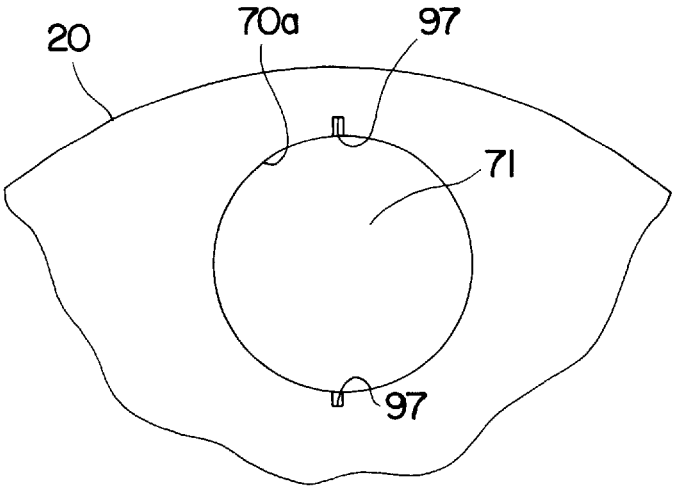
FIG. 16 is an enlarged fragmentary sectional side view taken along line 16—16 in FIG. 15.

FIGS. 15 and 16 illustrate an eighth embodiment of the present invention. This embodiment is similar to the first embodiment, except that no piston rings are provided. A plurality of grooves 97 are formed in inner surface 70*a* of cylinder 70. At least a portion of each groove 97 is located in surface portion L which is defined by axial right end 71*a* of piston 71 when piston 71 is at top dead center, and axial left end 71*b* of piston 71 when piston 71 is at bottom dead center. Preferably, axial length H of groove 97 is larger than height I of piston 71. According to this embodiment, passage of blowby gas is possible with virtually no gap between inner surface 70*a* and piston 71 (as more clearly shown in FIG. 16).

In the above-described embodiments, changing the number of piston rings affects the amount of blowby gas which passes through the grooves. This is due to changes in the friction between the rings and the blowby gas and by the fact that blowby gas may be partially deflected off the rearward surfaces of the piston rings. Also, changing the radial cross section the grooves affects, among other things, the amount of blowby gas which can pass therethrough as well as the complexity of the process of forming the grooves. Further, changing the location of the groove relative to the bottom dead center position of the piston can affect the amount of blowby gas that passes through the grooves. For example, if the grooves are located more closely to bottom dead center than top dead center, the blowby gas may be under a higher pressure, thereby causing a greater volume of blowby gas to pass through the grooves.

In the above-mentioned embodiments, the present invention is applied to a swash plate piston-type compressor with a capacity control mechanism. However, the present invention can be also applied to other piston-type compressors, such as a fixed capacity slant plate type compressor. Although the present invention has been described in connection with the preferred embodiment, the invention is not limited thereto. It will be easily understood by those having ordinary skill in the pertinent art that variations and modifications can be easily made within the scope of this invention. For example, certain features of the various embodiments may be interchanged or combined to provide, for example, different characteristics in the passage of blowby gas. Thus, the present invention is only limited by the claims which follow.

I claim:

1. A compressor comprising:

a compressor housing having a cylinder block, a front end plate disposed on one end of said cylinder block and a rear end plate disposed on an opposite end of said cylinder block, said rear end plate having a discharge chamber and a suction chamber formed therein, said cylinder block have a plurality of cylinders formed therein, said cylinder block defining a crank chamber between said front end plate and said cylinders;

a valve plate disposed between said cylinder block and said rear end plate, said valve plate having a plurality of discharge ports for passage of a compressed fluid from said plurality of cylinders into said discharge chamber and a plurality of suction ports for passage of a fluid from said suction chamber into said plurality of cylinders;

a plurality of discharge valve members disposed adjacent said valve plate for opening and closing each of said plurality of discharge ports;

a plurality of suction valve members disposed adjacent said valve plate for opening and closing each of said plurality of suction ports;

a plurality of pistons, one of which is slidably fitted within each of said plurality of cylinders, each of said cylinders defining a piston chamber between said one of said pistons and said valve plate;

a driving mechanism at least partially disposed within said crank chamber and coupled to said plurality of pistons to move said pistons in a reciprocating motion; and a passage means formed in an inner surface of each of said plurality of cylinders for passage of a fluid from said piston chambers to said crank chamber and along an entire axial length of said one of said pistons.

2. The compressor of claim 1 wherein said passage means comprises at least one groove.

3. The compressor of claim 2 wherein said at least one groove has an axial length greater than an axial thickness of said one of said plurality of pistons.

4. The compressor of claim 2 wherein a portion of said at least one groove is located within a surface portion of said cylinder, said surface portion defined by said cylinder between a rear end of said one of said pistons when said one of said pistons is at top dead center and a front end of said one of said pistons when said one of said pistons is at bottom dead center.

5. The compressor of claim 4 wherein said at least one groove is substantially parallel to an axis of said cylinder.

6. The compressor of claim 2 wherein said at least one groove has a rectangular radial cross section.

7. The compressor of claim 2 wherein said at least one groove has a triangular radial cross section.

8. The compressor of claim 2 wherein said at least one groove has a semi-circular radial cross section.

9. The compressor of claim 2 wherein said at least one groove has a trapezoidal axial cross section.

10. A compressor comprising:

a compressor housing having a cylinder block, a front end plate disposed on one end of said cylinder block, a rear end plate disposed on an opposite end of said cylinder block, said rear end plate having a discharge chamber and a suction chamber formed therein, said cylinder block have a plurality of cylinders formed therein, said cylinder block defining a crank chamber between said front end plate and said cylinders;

a valve plate disposed between said cylinder block and said rear end plate, said valve plate having a plurality of discharge ports for passage of a compressed fluid from said plurality of cylinders into said discharge chamber and a plurality of suction ports for passage of a fluid from said suction chamber into said plurality of cylinders;

a plurality of discharge valve members disposed adjacent said valve plate for opening and closing each of said plurality of discharge ports;

a plurality of suction valve members disposed adjacent said valve plate for opening and closing each of said plurality suction ports;

a plurality of pistons, one of which is slidably fitted within each of said plurality of cylinders, each of said cylinders defining a piston chamber between said one of said pistons and said valve plate;

a driving mechanism at least partially disposed within said crank chamber and coupled to said plurality of pistons to move said pistons in a reciprocating motion, said pistons each having at least one piston ring disposed about a periphery thereof; and a passage means formed in an inner surface of each of said plurality of cylinders for passage of a fluid from said piston chamber to said crank chamber and along an entire axial length of said one of said pistons.

11. The compressor of claim 10 wherein said passage means comprises at least one groove.

12. The compressor of claim 11 wherein said pistons each have one piston ring disposed about a periphery thereof, said at least one groove having an axial length greater than an axial thickness of said one piston ring.

13. The compressor of claim 11 wherein said pistons each have at least a first piston ring and a second piston ring disposed about a periphery thereof, said first piston ring being rearward most of said plurality of piston rings and said second piston ring being forwardmost of said plurality of piston rings, said at least one groove having an axial length greater than a distance from a rear end of said first piston ring and a front end of said second piston ring.

14. The compressor of claim 13 wherein at least a portion of said at least one groove is located in a surface portion of said cylinder, said surface portion defined by said cylinder between said rear end of said first piston ring when said piston is at top dead center and said front end of said second piston ring when said piston is at bottom dead center.

15. The compressor of claim 11 wherein said at least one groove is substantially parallel to an axis of said cylinder.

16. The compressor of claim 11 wherein said at least one groove has a rectangular radial cross section.

17. The compressor of claim 11 wherein said at least one groove has a triangular radial cross section.

18. The compressor of claim 11 wherein said at least one groove has a semicircular radial cross section.

19. The compressor of claim 11 wherein said at least one groove has a trapezoidal axial cross section.

20. A compressor comprising:

a compressor housing having a cylinder block, a front end plate disposed on one end of said cylinder block and a rear end plate disposed on an opposite end of said cylinder block, said cylinder block have a plurality of cylinders formed therein, said cylinder block defining a crank chamber between said front end plate and said cylinders;

a valve plate disposed between said cylinder block and said rear end plate;

a plurality of pistons, one of which is slidably fitted within each of said plurality of cylinders, each of said cylinders defining a piston chamber between said one of said pistons and said valve plate;

a driving mechanism at least partially disposed within said crank chamber and coupled to said plurality of pistons to move said pistons in a reciprocating motion; and a passage means formed in an inner surface of at least one of said plurality of cylinders for passage of a fluid from said piston chamber to said crank chamber and along an entire axial length of said one of said pistons.

21. A cylinder block for use in a piston-type compressor, said cylinder block having a plurality of cylinders formed therein, at least one of said cylinders adapted to slidably receive a piston therein and having a groove formed in a surface thereof, said groove having first and second ends, wherein the piston is movable between a first position, in which one end of the piston is between the first and second ends of said groove, and a second position, in which an opposite end of said piston is between the first and second ends of said groove, said groove allowing a fluid to pass therewithin from the one end of the piston to the opposite end of the respective piston.

* * * * *